United States Patent [19]

Spring

[11] Patent Number: 4,544,182

[45] Date of Patent: Oct. 1, 1985

[54] REVERSIBLE NUMERIC COLOR-CODED LABELS

[76] Inventor: Robert P. Spring, Box 306, Buckingham, Pa. 18912

[21] Appl. No.: 550,453

[22] Filed: Nov. 10, 1983

[51] Int. Cl.[4] ..... B42F 21/00

[52] U.S. Cl. ..... 283/81; 283/37; 283/38; 283/41; 283/42; 283/43

[58] Field of Search ..... 283/37, 38, 41, 42, 283/43, 81; 40/359, 360

[56] References Cited

U.S. PATENT DOCUMENTS

| | | | |
|---|---|---|---|
| 1,868,188 | 7/1932 | Barker | 283/81 X |
| 3,805,426 | 4/1974 | Cunningham | 283/41 X |
| 3,937,493 | 2/1976 | Fasbender | 283/41 |
| 4,240,848 | 12/1980 | Barber | 283/81 X |

FOREIGN PATENT DOCUMENTS

| | | | |
|---|---|---|---|
| 0785558 | 5/1968 | Canada | 283/37 |
| 0019906 | of 1911 | United Kingdom | 283/38 |

*Primary Examiner*—Paul A. Bell
*Assistant Examiner*—Taylor J. Ross
*Attorney, Agent, or Firm*—Gregory J. Gore

[57] ABSTRACT

The present invention relates to the field of office file labeling and discloses a label which is less expensive to manufacture and to apply to a normal numeric filing system. The label employs a color-coding system and includes perforations which permit unwanted portions of the label to be removed prior to application. The label is for numeric end-tab filing and is reversible about its central fold-line. Individual digits are rotated 180 degrees with respect to corresponding digits on the opposite side of the fold-line so that the digits are in readable orientation in either the reversed or non-reversed condition.

4 Claims, 4 Drawing Figures

REVERSIBLE NUMERIC COLOR-CODED LABELS

BACKROUND OF THE INVENTION

The instant invention pertains to the field of numeric labeling for the filing of various articles such as file folders. Labeling systems for filed articles are in common use throughout the office supply industry.

SUMMARY OF THE INVENTION

The present invention comprises a self-adhesive label which is folded about the end-tab of a file folder. The label includes a front portion adhereable to the front surface of the panel of a file folder and a second portion adhereable to the back surface of the same panel; each label portion containing given numeric digits arranged in a vertical format and so oriented that when the label is reversed about the foldline the numerical displayed on the front panel of the file folder is also in readable orientation. Hence, one label may be used for two different filing numbers. A color-coding system is also included which remains consistent in both the reversed and non-reversed use. Furthermore, the label also contains perforations along its surface in order to increase the flexibility of its possible applications and also for added clarity in that unwanted numbers may be removed from the back portion of the file panel after the label has been applied.

This system permits approximately half the number of different labels to be used for filing in a complete numeric order of given digit length, thus reducing costs through saving materials and labor. For example, numeric labeling for numbers from 0 to 99 using two-digit labels will require 100 different labels ordinarily, while using the system presently disclosed requires only 55 different labels. One hundred labels will still be required by the 100 different articles however only 55 will be different, thus saving printing and application costs.

More specifically, the present invention is a file label for end-tab, numeric labeling which in a flat horizontal condition has a central foldline, a front portion on one side of the foldline, a back portion on the opposite side of the foldline, said front part having two or more digits thereon arranged in a vertical column parallel to the foldline, said back portion of the label having individually identical digits thereon as on the front portion also vertically arranged except that each digit on the back portion is rotated 180° with respect to its corresponding digit on the front portion of the label. Color bars are included between sets of corresponding digits which fall on both sides of the foldline. The label also contains two lines of perforations along its surface parallel to the foldline; one on the front portion of the label located between the indicia field and the color bars, and one on the back portion of the label between the indicia field and the color bars. Furthermore, the label contains additional lines of perforations perpendicular to the foldline having one line of perforations between neighboring digits.

DESCRIPTION OF THE PREFERRED EMBODIMENT

Figure 1:
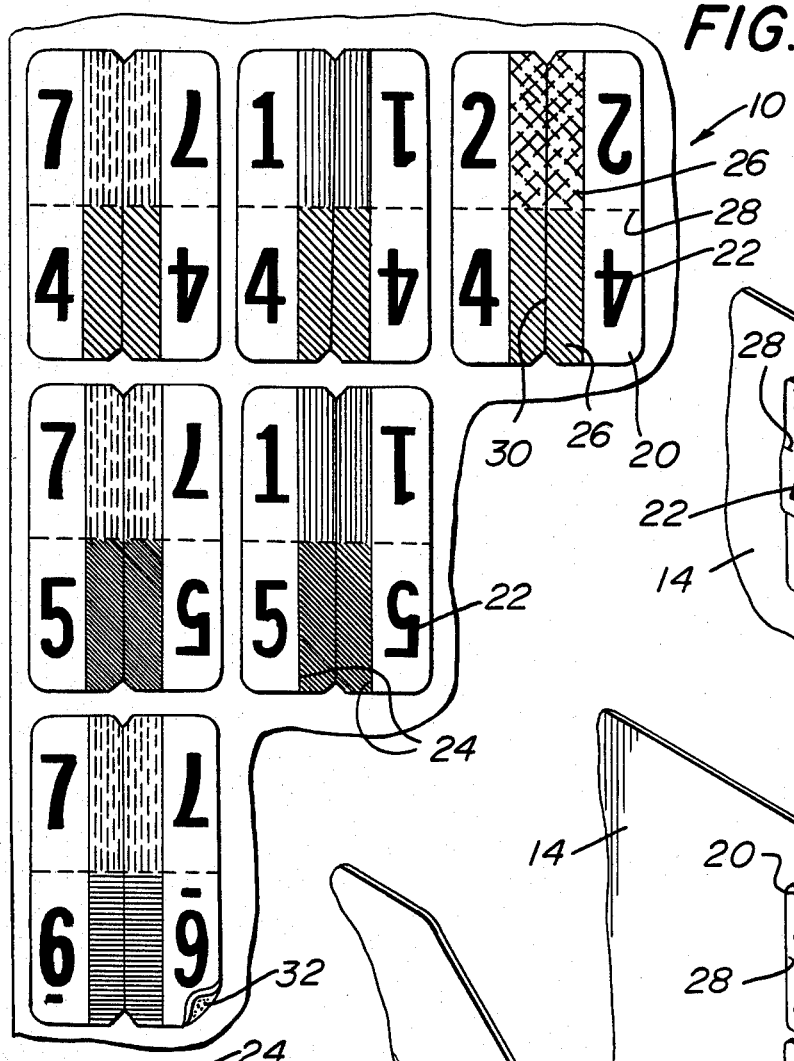
FIG. 1 shows several examples of two-digit labels as prepared according to the present invention.

Referring to FIG. 1, there is disclosed several examples of two-digit file labels prepared in accordance with the instant invention. It can be readily seen that each label may be used as an end tab label in either its reversed or non-reversed condition with foldline 30 falling along the edge of the file panel in either orientation. The label presenting "74" becomes "47" when reversed. The label in "14" becomes "41", and so on. Each label contains color bars 26 keyed to each different digit 22. The specific colors are keyed as follows: 0 is pink; 1 is red; 2 is light orange; 3 is dark orange, 4 is light green; 5 is dark green; 6 is blue; 7 is purple; 8 is lavendar; and 9 is brown. Adhesive backing 32 is used to secure the labels.

Perforation lines 24 permit unwanted indicia to be removed prior to application. Additional perforations 28 which run front-to-back between neighboring digits permit two single-digit labels to be created from one two-digit label.

Figure 2:
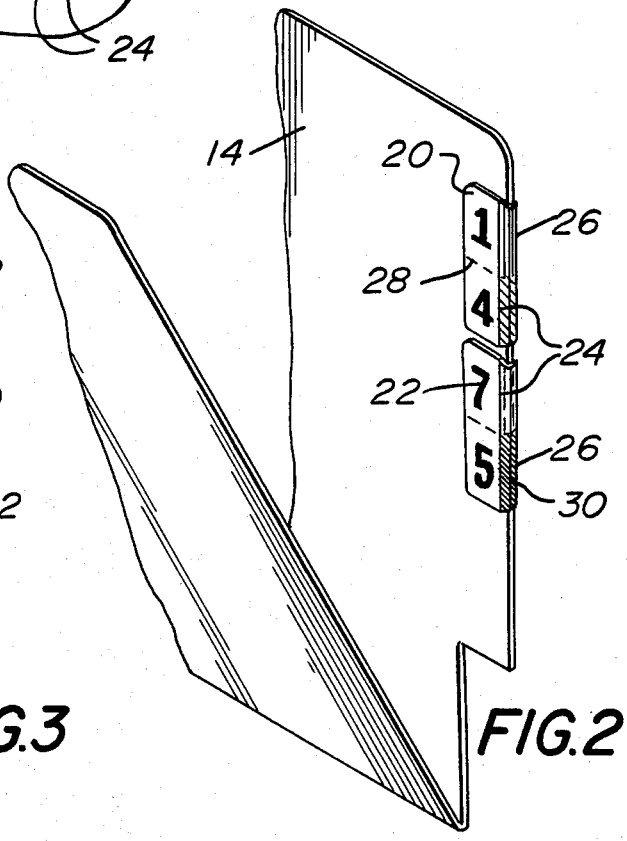
FIG. 2 shows a typical location of the end-tab label on a file folder.

Referring to FIG. 2, end-tab labels are shown applied across the end edge of a typical file folder 14. Color bars 26 fall across the folder's edge across foldline 30.

Figure 3:
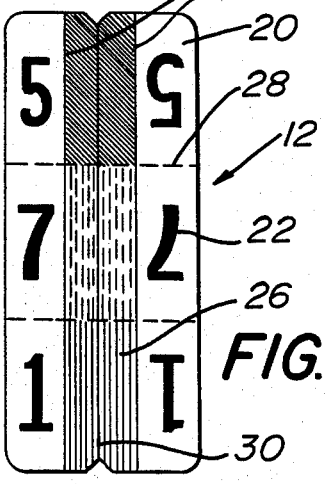
FIG. 3 shows an embodiment of the invention which contains three-digit length numerals

Referring to FIG. 3, the instant invention may be adapted to any digit length. Here, label 12 shows a three-digit label which may be used as either the number "571" of the number "175" when reversed.

Figure 4:
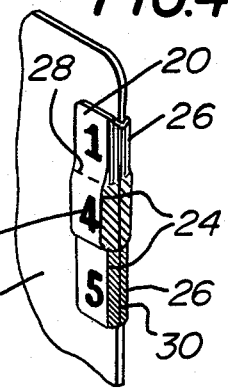
FIG. 4 shows a method of overlapping two two-digit labels to obtain a three-digit sequence.

Referring to FIG. 4, two or more labels may be applied in an overlapping manner to create different numeric sequences as desired. Here, two, two-digit labels are applied to produce a three-digit sequence by overlapping one digit.

It should be understood that the file labels described herein are susceptable to adaptations and furthermore, it will be obvious to those of ordinary skill in the art that many changes and modifications may be made to the specific embodiments portrayed herein without departing from the spirit and scope of the invention.

What I claim is:

1. A file folder label, comprising:

(a) a central foldline;

(b) a front portion on one side of the foldline;

(c) a back portion on the opposite side of the foldline;

(d) numeric digits on the front portion arranged in a vertical column parallel to the foldline in a given order, top to bottom;

(e) numeric digits on the back portion each individually identical to the digits on the front portion and arranged likewise in a vertical column parallel to the foldline in the same order, top to bottom, as the digits on the front portion, each digit on the back portion being rotated 180 degrees with respect to its corresponding digit on the front portion.

2. The label of claim 1 further including color bars between each pair of corresponding digits, each color bar lying across the foldline in both front and back portions.

3. The label of claim 2 further including two perforation lines parallel to the foldline located on each portion between the color bars and the digits.

4. The label of claim 3 further including perforation lines perpendicular to the foldline located between neighboring digits.

* * * * *